United States Patent [19]

Young

[11] 4,311,735

[45] Jan. 19, 1982

[54] IMPREGNATION OF POROUS ARTICLES

[75] Inventor: Peter D. Young, St. Andrews, Guernsey, Channel Islands

[73] Assignee: Ultraseal International Limited, Vale, Guernsey, Channel Islands

[21] Appl. No.: 162,645

[22] Filed: Jun. 24, 1980

[51] Int. Cl.[3] ..... C23C 13/08; B05C 3/00; B05D 1/18; B05D 3/00

[52] U.S. Cl. ..... 427/295; 118/50; 118/416; 427/354; 427/388.2; 427/435

[58] Field of Search ..... 427/294, 295, 388.2, 427/354, 435; 118/50, 416

[56] References Cited

U.S. PATENT DOCUMENTS

| | | | |
|---|---|---|---|
| 3,701,676 | 10/1972 | Bader et al. | 427/295 |
| 3,969,552 | 7/1976 | Malotsky | 427/295 |
| 4,147,821 | 4/1979 | Young | 427/295 |

FOREIGN PATENT DOCUMENTS

| | | | |
|---|---|---|---|
| 1926126 | 1/1971 | Fed. Rep. of Germany | 427/295 |
| 1547801 | 6/1979 | United Kingdom . | |

*Primary Examiner*—Michael R. Lusignan
*Attorney, Agent, or Firm*—Oblon, Fisher, Spivak, McClelland & Maier

[57] ABSTRACT

A method of impregnating a porous article with impregnant to seal the pores thereof, which comprises placing the article in a vessel, evacuating the vessel to withdraw air from the pores, releasing the vacuum with the pores beneath the surface of a liquid impregnant in the vessel, removing excess impregnant from the vessel, washing excess impregnant from the surface of the article by supplying washing fluid to the vessel, removing the fluid from the vessel, heating the article while still within the vessel to effect curing of the impregnant within the pores, and removing the impregnated article from the vessel.

11 Claims, 1 Drawing Figure

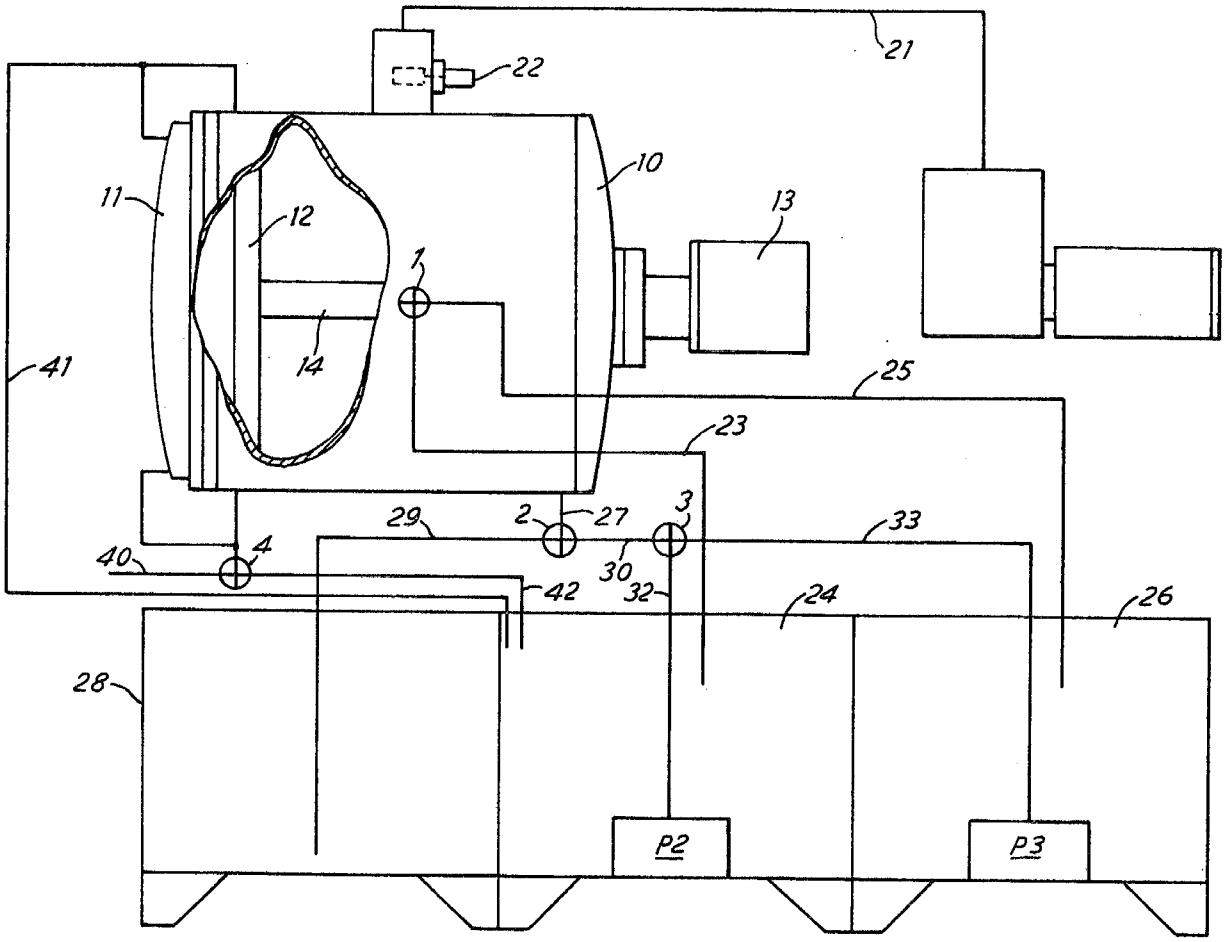
21
22
13
10
12
14
11
41
1
2
3
4
23
25
27
29
30
32
33
40
42
24
26
28
P2
P3

IMPREGNATION OF POROUS ARTICLES

This invention relates to the sealing-impregnation of porous articles, particularly though not exclusively metal castings. Other porous articles which may be treated include wood and inorganic materials such as brick, stone or concrete. It is, important however, that the pores in the material are not so big as to permit leaching out of the impregnant.

The impregnation of metal castings with resins to seal porosity is a process which is well established. Porosity in castings is invariably inconsistent in size and shape thus rendering the components unusable due to leakage. This is particularly true where they are subjected to pressure. Apart from this well known cause for rejection of castings used in the motor industry there are many other problems caused by porosity including plating failures, "blow-out" during stove enamelling, and sites for corrosion, entrapment of organic material and possible bacteria growth.

Various methods of impregnating metal castings have been devised and used over the years, including heating the casting and dipping into a thermosetting Bakelite solution thereby inducing penetration of the impregnant caused by the shrinkage of the air in the porosity as the component cools. This was ultimately replaced by filling the component to be sealed with the impregnant by pressurising so as to force it through the inter-connecting porosity within the component. Alternatively, for smaller and high production components, the vacuum impregnation technique currently used was developed in which the components to be treated were packed into a process basket and then lowered into a vessel within which a vacuum was pulled to from 28 to 29 inches Hg. After a short time the resin impregnant was admitted from a storage tank until the vessel was flooded. At this point the vacuum was released and pressure applied so as to assist the impregnant into the pores of the components. The resin was then transferred to the storage tank and the charge was removed, drained and subjected to a washing cycle whereby the surplus surface resin was removed. This was normally carried out in a separate tank where the basket was reciprocated in an aqueous or organic solvent. The charge was then transferred either to an oven or to a bath containing a hot transfer liquid, for solidification of the impregnant. Where non-thermal polymerisable materials are used, polymerisation or natural solidification of the impregnant would be carried out at room temperature. In such cases the components would be left to stand for up to 24 hours before pressure testing could be carried out; a drawback where rapid treatment is required.

Thus it is conventional to transfer the charge through a series of tanks for completion of the impregnation cycle. However, it has now been found that the process basket may remain within the pressure vessel for the complete impregnation cycle. This is made possible by connecting the impregnation vessel by way of valving to the various storage tanks containing the liquids used in the process. During the cycle such valves may be either manually activated or automatically controlled, the latter being preferable.

According to one aspect of the invention, there is provided a method of impregnating a porous article with impregnant to seal the pores thereof, which comprises placing the article in a vessel, evacuating the vessel to withdraw air from the pores, releasing the vacuum with the pores beneath the surface of a liquid impregnant in the vessel, removing excess impregnant from the vessel, washing excess impregnant from the surface of the article by supplying washing fluid to the vessel, removing the fluid from the vessel, heating the article while still within the vessel to effect curing of the impregnant within the pores, and removing the impregnated article from the vessel.

According to another aspect of the invention, there is provided apparatus for carrying out this method comprising a pressure vessel, means for supporting the article within the vessel, means for applying a vacuum to the vessel, means for supplying liquid impregnant to the vessel and removing it therefrom, means for supplying washing fluid to the vessel and removing it therefrom and means for heating the article within the vessel.

The impregnation vessel is desirably placed horizontally and fitted with a cage within which the charge is placed. At various stages during the treatment both cage and charge are desirably rotated to facilitate impregnation, draining and washing.

The invention is particularly though not exclusively applicable to the impregnants and methods described in British Pat. No. 1,547,801 as both the post treatment washing and curing is there carried out using water only. In certain instances when treating ferrous components, the hot water wash can contain corrosion inhibitors which are designed so as not to adversely contaminate the impregnant by way of pickup from the impregnation vessel (autoclave).

Although low viscosity methacrylate-based impregnants are generally found to perform satisfactorily when drawing a wet vacuum only i.e. submerging the charge to be impregnated in the liquid in the autoclave and then extracting the air from the porosity by drawing a vacuum in the vessel, it is nevertheless accepted that degassing of porosity from submerged components can take considerably longer than when using a dry vacuum at the same ultimate pressures. It follows therefore that by drawing a dry vacuum on a charge, the time allowed can be significantly reduced without producing a loss of sealing performance.

In some instances it is desirable to incorporate a centrifuging step, particularly when treating certain complex components. the centrifuged charge could be programmed to spin after each cycle e.g. impregnation, cold wash and hot wash.

If need be the vessel could be trunnion mounted, providing flexibility in loading of the charge and selecting the position in which the charge should be treated. For instance it might be advantageous to load and unload the vessel vertically, impregnate and drain horizontally, and centrifuge vertically. This cycle could be repeated for both cold and hot washes.

If the impregnant is sensitive to elevated temperatures, from which polymerization could result, the autoclave should be cooled to room temperature before re-admittance of the impregnant in a subsequent cycle. This may be achieved by jacketing the vessel and passing cold water around it.

An embodiment of the invention is illustrated diagrammatically in the accompanying FIGURE which shows an impregnation vessel with part of its wall broken away and various ancillary equipment.

The impregnation vessel 10 is a hollow cylindrical autoclave closed at the right hand end and having a door 11 at the left hand end. A cylindrical basket 12 is mounted within the vessel 10 for rotation about a horizontal axis by a suitable drive unit 13. The basket 12 may be removed from the vessel 10 to facilitate loading e.g. it may be slidable axially on and off a cantilever rotary shaft 14 to which it is attached during operation, or it may be held within a rotatable cage (not shown).

A vacuum pump P1 is connected by line 21 and, for convenience, the housing of level switch 22 to the top of the vessel 10. Half way up the wall of the vessel 10 is a two-way overflow valve 1 which during certain phases of operation permits liquid to flow out of the vessel either via a line 23 to a cold water wash storage tank 24 or via a line 25 to a hot water wash storage tank 26. A further two-way valve 2 selectively connects an inlet line 27 to the bottom of the vessel to the impregnant storage tank 28 via line 29 or to a two-way valve 3 via line 30. Valve 3 selectively connects line 30 to pump P2 via line 32 or to pump P3 via line 33, pump P2 being connected to tank 24 and pump P3 to tank 26.

Respective cooling jackets are provided in the walls of the vessel 10 and its door 11. A coolant inlet line 40 supplies a two-way valve 4 which distributes the coolant selectively either to the cooling jackets and thence via line 41 to tank 24 or directly to tank 24 via line 42.

Operation is as follows. After loading the vessel 10 the door 11 is closed and all valves are closed. Pump P1 is then started in order to pump out air and degas the components being treated. After a predetermined time, valve 2 connects line 27 to line 29 and impregnant is sucked into vessel 10 until it reaches level switch 22 whereupon pump P1 cuts out. During this operation the basket 12 is slowly rotated to minimize gas entrapment. The vacuum is then broken and the impregnant drained from the vessel via lines 27 and 29; positive pressure could be applied to the vessel at this stage if desired. The basket continues to rotate to effect maximum drainage.

Washing is effected by connecting line 27 to line 30 by valve 2, by connecting line 30 to line 32 by valve 3, by operating pump P2 and by connecting the overflow to line 23 by valve 1. After washing, the vessel is drained by turning off pump P2, the basket continuing to rotate throughout.

Curing is effected by supplying hot water (or other curing liquid) from tank 26 using pump P3, valve 1 now connecting the overflow to line 25 and valve 3 now connecting line 30 to line 33. This cycling action permits any heat loss to be made up by a thermostatic heater (not shown) in tank 26. The basket continues to rotate throughout.

The finished articles (components) are then removed. Although the vessel is still hot, the next cycle may be started promptly since the vessel and its door may be cooled (by diverting coolant through the jacket via valve 4) during the evacuation step.

The above operations are summarised in the following Table:

| LOAD CHARGE INTO VESSEL & CLOSE DOOR | | | VALUES | | | | | | | | PUMPS | | | LEVEL | TIME D | DRIVE | |
|---|---|---|---|---|---|---|---|---|---|---|---|---|---|---|---|---|---|
| | | | 1 | | 2 | | 3 | | 4 | | | | | | | | |
| CYCLE | No | FUNCTION | A | B | A | B | A | B | A | B | P1 | P2 | P3 | SWITCH | CYCLE | UNIT | REMARKS |
| IMPREGNATE | 1 | DRY VACUUM | — | — | — | — | — | — | ✓ | — | ✓ | — | — | — | ✓ | — | |
| " | 2 | SEALANT SUCK UP | — | — | ✓ | — | — | — | — | ✓ | ✓ | — | — | ✓ | — | ✓ | |
| " | 3 | SEALANT DRAIN | — | — | ✓ | — | — | — | — | ✓ | — | — | — | — | ✓ | ✓ | |
| FIRST WASH | 4 | FLOOD VESSEL | — | ✓ | — | ✓ | ✓ | — | — | ✓ | — | ✓ | — | — | ✓ | ✓ | WASH IS CYCLED BACK TO STORAGE TANK |
| FIRST WASH | 5 | DRAIN VESSEL | — | ✓ | — | ✓ | ✓ | — | — | ✓ | — | — | — | — | ✓ | ✓ | |
| SECOND WASH | 6 | FLOOD VESSEL | ✓ | — | — | ✓ | — | ✓ | — | ✓ | — | — | ✓ | — | ✓ | ✓ | WASH IS CYCLED BACK TO STORAGE TANK |
| SECOND WASH | 7 | DRAIN VESSEL | ✓ | — | — | ✓ | — | ✓ | — | ✓ | — | — | — | — | ✓ | ✓ | |
| OPEN DOOR & REMOVE CHARGE | | | — | — | — | ✓ | — | — | — | ✓ | — | — | — | — | — | — | |

✓ ACTIVATED
— NOW ACTIVATED
The valve positions A, B have the following connections:-
1A = line 25; 1B = line 23; 2A = line 29; 2B = line 30; 3A = line 32; 3B = line 33; 4A = line to autoclave; 4B = line 42.

In an alternative arrangement (not shown) the cold water wash charge to the autoclave is provided from a header tank from which the water will flow by gravity into the autoclave by way of the overflow valve 1. The volume of water to enter the autoclave is predetermined in the header tank and usually represents 50% of the volume of the vessel. During the cold wash cycle valve 2 remains closed. Drainage will then result by indexing valve 2 to line 30 and valve 3 to line 32 which is connected to waste. This alteration removes the need for Pump 2 (though the illustrated version of the apparatus is more economical on water consumption).

Advantages which may be gained from automatic impregnation as set out in the Table are:

1. A fast and simple automatic cycle, and thus reduction in scope for human error.
2. Packing of castings and process baskets becomes less critical as air locks and impregnant entrapment is reduced by rotation of the process basket.
3. Effective draining between cycles.
4. Consistent quality of cleanliness of component resulting from effective washing action.
5. Small floor space.

6. Improved operation environmental conditions.
7. Possibility of introducing such safety measures as monitoring the temperature of the impregnation vessel and the work load which would automatically reject the charge if as the result of previous treatments it has accidentally been loaded into the unit while it was still hot.

The present invention is particulrly advantageous when washing and curing are effected with water only (the impregnant may contain an emulsifier to facilitate water-washing as explained in British Pat. No. 1,547,801). This facilitates dealing with any cross contamination within the system. For instance, if the impregnant becomes contaminated with a small amount of water, this can be dealt with by streaming dry air through the impregnant while it is under high vacuum using conventional techniques. The apparatus of the invention may be fitted with a device which will allow the impregnant to be scrubbed dry automatically, outside production time.

I claim:

1. A method of impregnating a porous article with impregnant to seal the pores thereof, which comprises placing the article in a vessel, evacuating the vessel to withdraw air from the pores, releasing the vacuum with the pores beneath the surface of a liquid impregnant in the vessel, removing excess impregnant from the vessel, washing excess impregnant from the surface of the article in said vessel by supplying washing fluid to the vessel, removing the fluid from the vessel, heating the article while still within the vessel to effect curing of the impregnant within the pores, and removing the impregnated article from the vessel, wherein the article is rotated during at least a portion of the treatment of the article.

2. A method according to claim 1 wherein the liquid impregnant is supplied to the vessel after evacuation.

3. A method according to claim 1 wherein the washing fluid is aqueous.

4. A method according to claim 1 wherein the heat-curing is effected with hot water.

5. The method of claim 1 wherein said article is in a basket.

6. A method according to claim 1 wherein the basket is rotatable about a substantially horizontal axis.

7. A method according to claim 1 including the step of subsequently cooling the vessel.

8. A method according to claim 7, wherein cooling is effected by passing water through a cooling jacket.

9. Apparatus for impregnating a porous article with impregnant to seal the pores thereof comprising a pressure vessel, means for supporting the article within the vessel, means for applying a vacuum to the vessel and removing it therefrom, means for supplying liquid impregnant to the vessel and removing it therefrom, means for supplying washing fluid to the vessel and removing it therefrom and means for heating the article within the vessel, wherein said means for supporting the article is adapted to rotate the article.

10. The apparatus of claim 9 wherein said means adapted to rotate the article is a basket.

11. Apparatus according to claim 9, wherein said means for heating the article comprises means for supplying hot water to the vessel.

* * * * *